US007360864B2

(12) United States Patent
Kawai et al.

(10) Patent No.: US 7,360,864 B2
(45) Date of Patent: Apr. 22, 2008

(54) WASTE INK TANK AND INKJET RECORDING APPARATUS

(75) Inventors: Takamitsu Kawai, Obu (JP); Masafumi Kawaura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 342 days.

(21) Appl. No.: 11/071,273

(22) Filed: Mar. 4, 2005

(65) Prior Publication Data

US 2005/0195241 A1 Sep. 8, 2005

(30) Foreign Application Priority Data

Mar. 5, 2004 (JP) ..... 2004-063178
Jul. 15, 2004 (JP) ..... 2004-208176

(51) Int. Cl.
*B41J 2/165* (2006.01)

(52) U.S. Cl. ..... 347/36

(58) Field of Classification Search ..... 347/22, 347/29–36

See application file for complete search history.

(56) References Cited

U.S. PATENT DOCUMENTS 5,680,162 A * 10/1997 Taylor et al. ..... 347/35
5,774,142 A * 6/1998 Nguyen et al. ..... 347/35
5,831,647 A 11/1998 Kawakami et al.
6,375,305 B2 * 4/2002 Sugimoto et al. ..... 347/36
6,663,215 B2 12/2003 Klausbruckner et al.
6,866,363 B2 * 3/2005 Oku ..... 347/36

FOREIGN PATENT DOCUMENTS

| | | |
|---|---|---|
| JP | 9-85965 | 3/1997 |
| JP | 10-119256 | 5/1998 |
| JP | 11-129504 | 5/1999 |
| JP | 2001-171148 | 6/2001 |

* cited by examiner

*Primary Examiner*—Shih-Wen Hsieh
(74) *Attorney, Agent, or Firm*—Banner & Witcoff, Ltd

(57) ABSTRACT

A waste ink tank including: a first storing section that stores waste ink and has an evaporation opening for the waste ink; a second storing section that stores the waste ink and is deeper than the first storing section, the second storing section having an evaporation opening which is smaller than that of the first storing section; and a waste ink receiving section which connects the first storing section and the second storing section and into which the waste ink is made to flow, the waste ink receiving section connecting the first storing section and the second storing section at a bottom surface thereof that is horizontal when the waste ink tank is used.

29 Claims, 15 Drawing Sheets

WASTE INK TANK AND INKJET RECORDING APPARATUS

BACKGROUND OF THE INVENTION

1. Field of the Invention

The present invention relates to an inkjet recording apparatus which ejects ink to form an image on a paper. More particularly, the invention relates to an inkjet recording apparatus having a storing section which contains waste ink discharged as a result of a recording head maintenance operation.

2. Description of the Related Art

When an inkjet recording apparatus according to the related art is used again after leaving it unused for a long time, in order to eliminate the effect of clogging of a multiplicity of ink ejection holes formed at the recording head thereof, a maintenance process is required prior to the restart of use, in which a negative pressure is applied to ink channels including the ink ejection holes to extract any ink staying in the channels. The extracted ink is stored in a waste ink tank in the printer rather than being discharged from the recording apparatus as waste ink.

When so-called edgeless printing is performed, since the ink ejection range exceeds the range of the printing paper, ink accumulated on the platen is collected as waste ink and stored in a waste ink tank.

Under the circumstance, Japanese Patent No. 3284453 (FIGS. 2 and 3), JP-A-11-129504 (FIGS. 1, 2, and 3) and JP-A-2001-171148 (FIG. 6) disclose techniques to prevent leakage of such waste ink.

The point of the disclosure of Japanese Patent No. 3284453 is to divide a waste ink containing chamber into a plurality of compartments. The point of the disclosure of JP-A-11-129504 is to divide an absorbing foam that fills a waste ink containing chamber into two parts and to provide a space between those parts, and a configuration is also disclosed, in which waste ink flows into one of the parts when the waste ink can no longer be absorbed by the other part. JP-A-2001-171148 discloses a configuration in which a waste ink storing chamber is divided into a plurality of compartments by partition walls and in which each of the compartments is filled with foam for absorbing waste ink.

SUMMARY OF THE INVENTION

However, in any of the above-described configurations according to the related art, since the waste ink tank itself has an overall shape that is a simple rectangular parallelepiped, a problem has arisen in that evaporation of waste ink takes time and the waste ink can consequently spill out when it is generated in a large amount at a time, although the shape promotes quick absorption of waste ink.

In the case that a waste ink tank is divided into two parts, since there is no device to deliver and store waste ink in those parts evenly, waste ink must be made to flow into one of the storing chambers when the other storing chamber becomes full. In such an occasion, the problem of the leakage of waste ink has also occurred.

In addition to yellow, magenta, cyan, and black, halftones of at least two colors among yellow, magenta, and cyan are recently used as colors which allow regions in halftones in a photograph to be finely rendered, thereby allowing rendering in six or seven colors. As a result, a maintenance process is performed a greater number of times than in the case of four color rendering according to the related art, and ink is wasted in a greater amount. A possible solution to this is to increase the area of an opening of a box-shaped tank that is located on a top side of the tank in order to allow collected waste ink to be efficiently evaporated. However, since the tank is made shallow accordingly, the amount of waste ink that can be stored decreases. In addition, a problem arises in that ink can spill out the tank and smear a transporting path inside the apparatus when the apparatus is tilted during transportation after the use of the same is started.

The invention provides a waste ink tank which can achieve both of quick evaporation of waste ink and effective storage of a large amount of waste ink while occupying only a small space and which has a structure that allows waste ink to flow into each storing section substantially evenly when there is a plurality of waste ink storing sections.

According to an aspect of the present invention, there is provided a waste ink tank including: a first storing section capable of storing waste ink, which has an evaporation opening for the waste ink; a second storing section capable of storing waste ink, which is deeper than the first storing section, the second storing section having an evaporation opening which is smaller than that of the first storing section; and a waste ink receiving section having a bottom surface that has a receiving portion capable of receiving the waste ink made to flow into the waste ink receiving section and a connecting portion connecting the first storing section and the second storing section, and that is horizontal when the waste ink tank is used.

Since the waste ink tank is formed by the first storing section having the smaller depth and larger evaporation opening and the second storing section having the greater depth and smaller evaporation opening, the ink tank can achieve both of quick evaporation of waste ink and effective storage of a large amount of waste ink while occupying only a small space.

Since the first storing section and the second storing section are connected through an inner bottom surface of the waste ink receiving section that is horizontal when the tank is used, waste ink can be made to flow into the storing sections evenly.

According to another aspect of the invention, there is provided a waste ink tank including:a storing section that is open on a top side thereof; a waste ink receiving section to which waste ink is made to flow, the waste ink receiving section being formed in the storing section; an absorbing body that is contained in a portion of the storing section other than a portion where the waste ink receiving section is formed and holds the waste ink; and a cover that covers at least the waste ink receiving section. Therefore, even when an ink jet recording apparatus is tilted after it is put in use for reasons including transportation of the same, ink will not leak inside the apparatus because the waste ink receiving section having no absorbing body therein is covered by the cover.

According to still another aspect of the invention, there is provided an inkjet recording apparatus including: a paper supplying unit on which a paper is placed; a transporting unit which transports the paper from the paper supplying unit while U-turning the paper from a lower side to an upper side in a transporting path; a recording unit that forms an image on the paper in the transporting path; a sucking unit that sucks waste ink from the recording unit; and a storing section provided outside a curve of a U-turn of the transporting path, the storing section storing the waste ink sucked by the sucking unit. Therefore, a large amount of waste ink discharged in an inkjet recording apparatus can be effectively stored to make the apparatus compact.

According to the invention, the absorbing body is contained except the neighborhood of a waste liquid receiving section of the storing section to allow ink to flow in smoothly, and at least the waste liquid receiving section which does not contain the absorbing body is covered by the cover. Therefore, even when the ink tank is tilted, it is possible to prevent ink accumulated in the waste liquid receiving section from flowing on an inner wall of the tank to leak out the tank inside the apparatus.

BRIEF DESCRIPTION OF THE DRAWINGS

The present invention may be more readily described with reference to the accompanying drawings:

FIGS. 1A and 1B are perspective views of the exterior of a waste ink tank according to a first embodiment in which FIG. 1A is a schematic perspective view taken from the front side of the tank, looking down in an oblique direction and FIG. 1B is a perspective view of the same taken from the rear side thereof, looking down in an oblique direction;

FIGS. 6A and 6B are perspective views of the exterior of a waste ink tank according to a second embodiment in which FIG. 6A is a schematic perspective view taken from the front side of the tank, looking down in an oblique direction and FIG. 6B is a perspective view of the same taken from the rear side thereof, looking down in an oblique direction;

DETAILED DESCRIPTION OF THE PREFERRED EMBODIMENTS

Embodiments of the invention will now be described with reference to the drawings. The embodiments described below are embodiments of the application of the invention to a waste ink tank provided in an inkjet type printer.

(1) First Embodiment

Figure 1A:
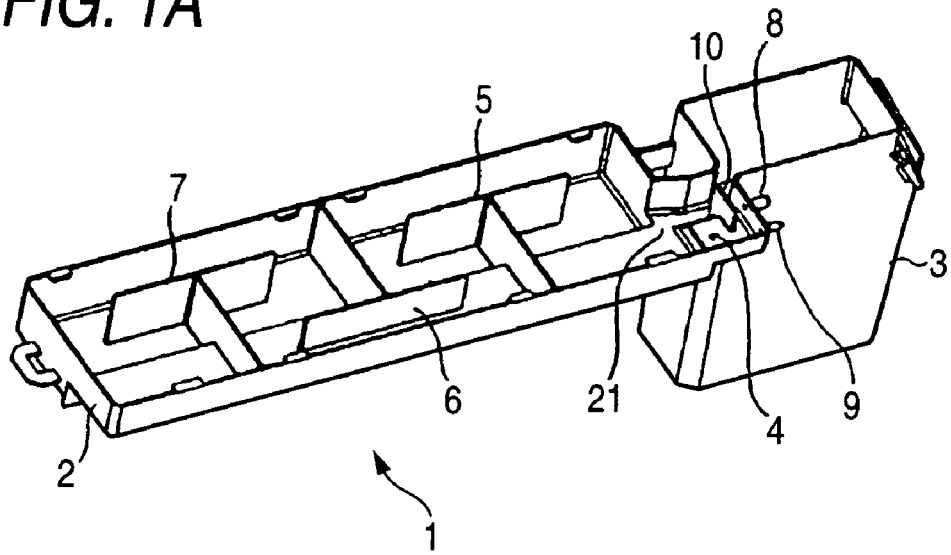
Figure 1B:
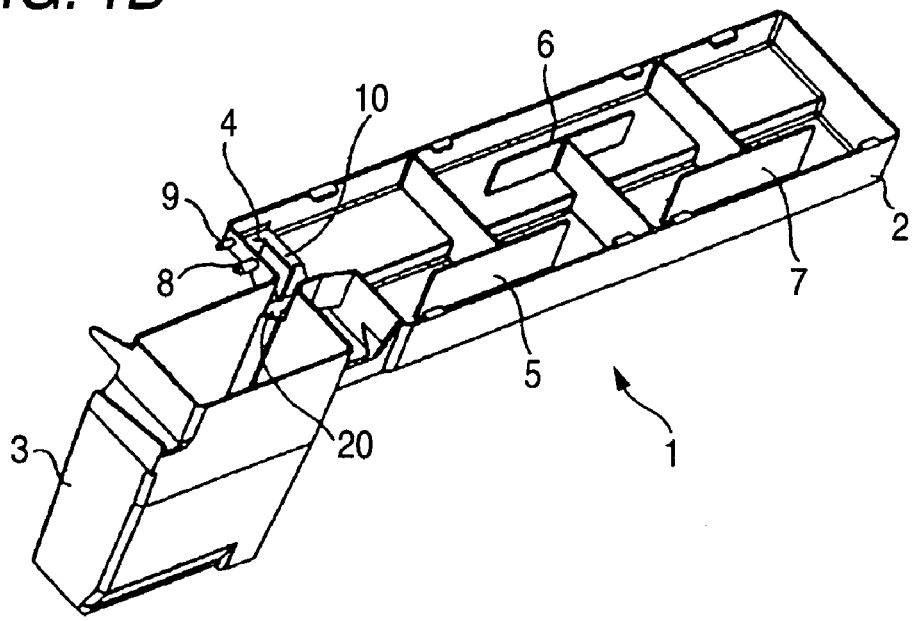
Figure 2:
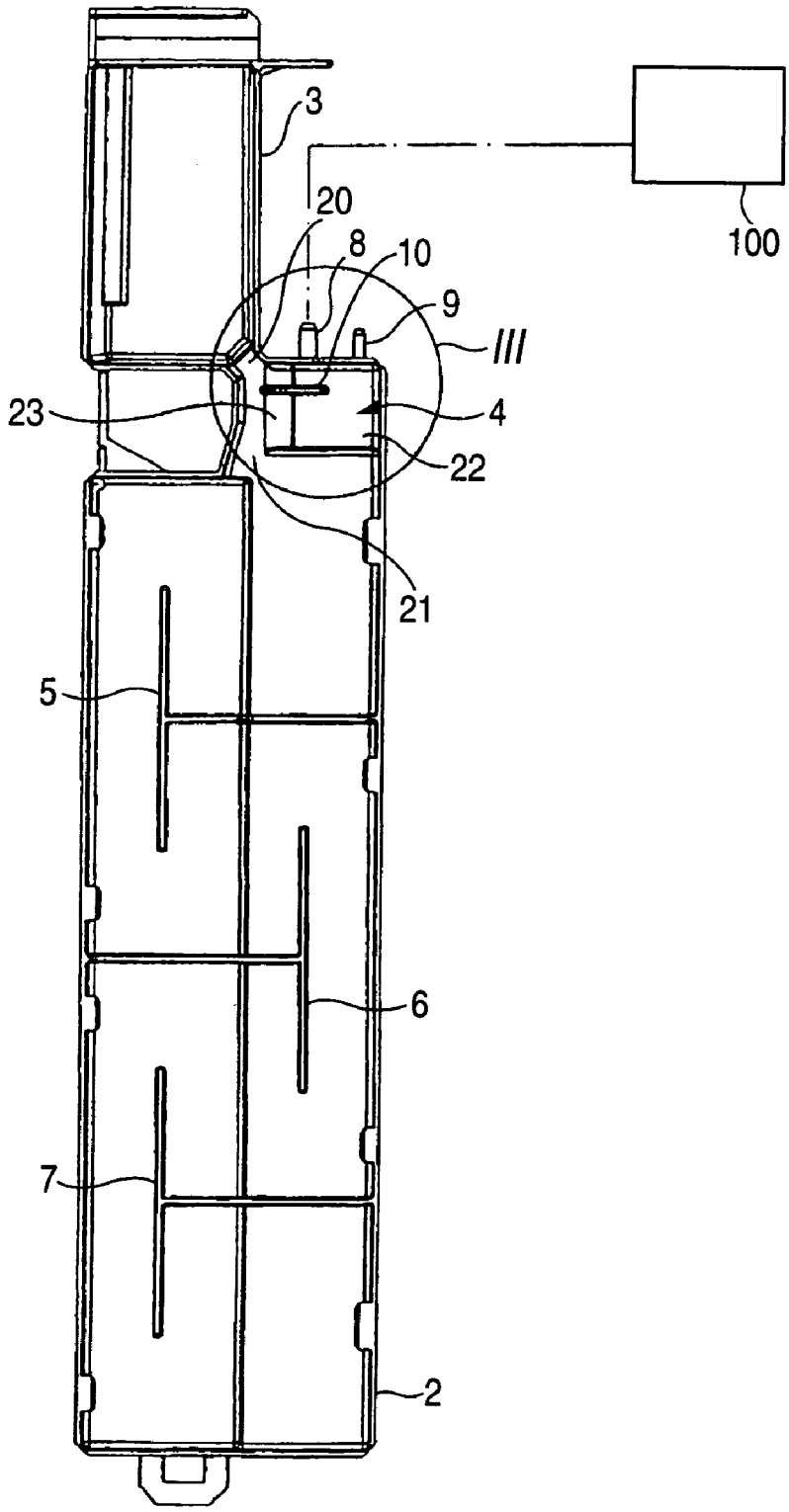
FIG. 2 is a plan view of the waste ink tank according to the first embodiment, showing a detailed configuration thereof.
Figure 3:
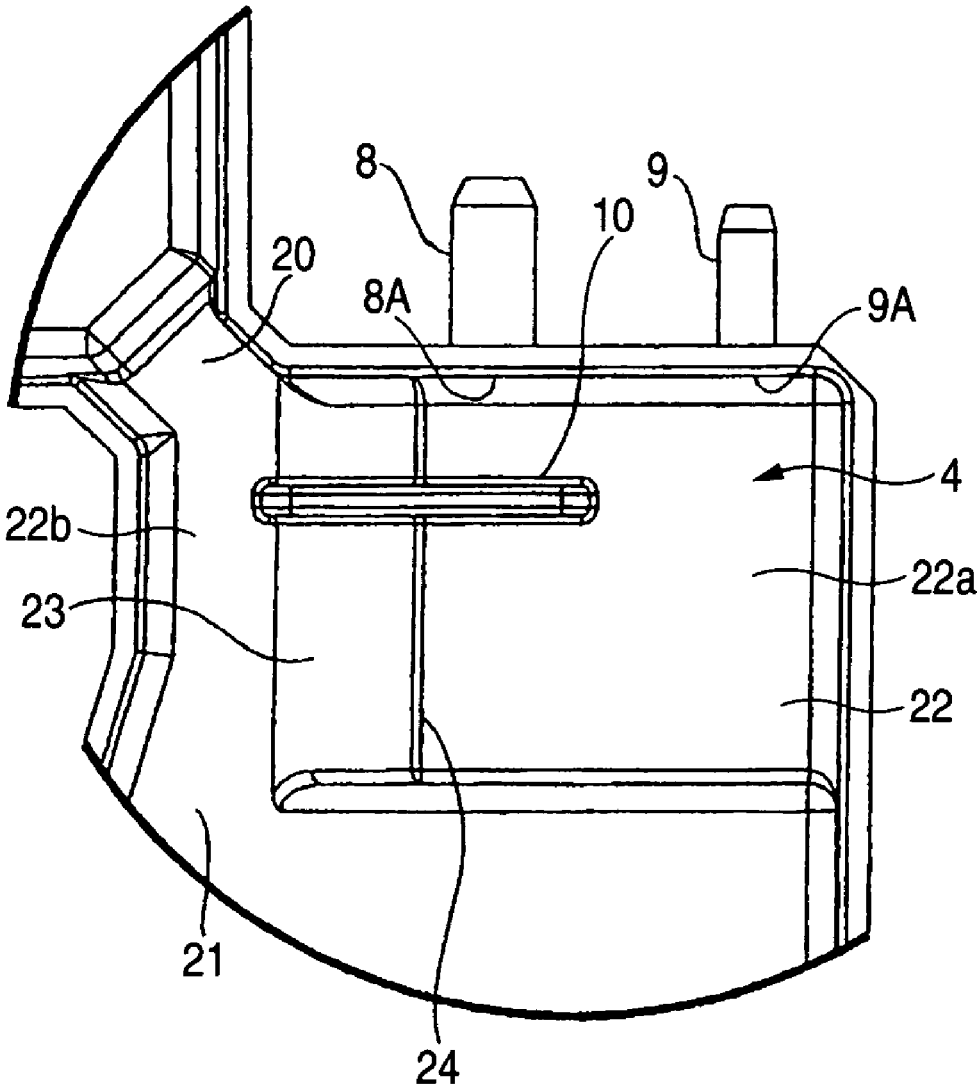
FIG. 3 is an enlarged plan view of the region III in FIG. 2.
Figure 4:
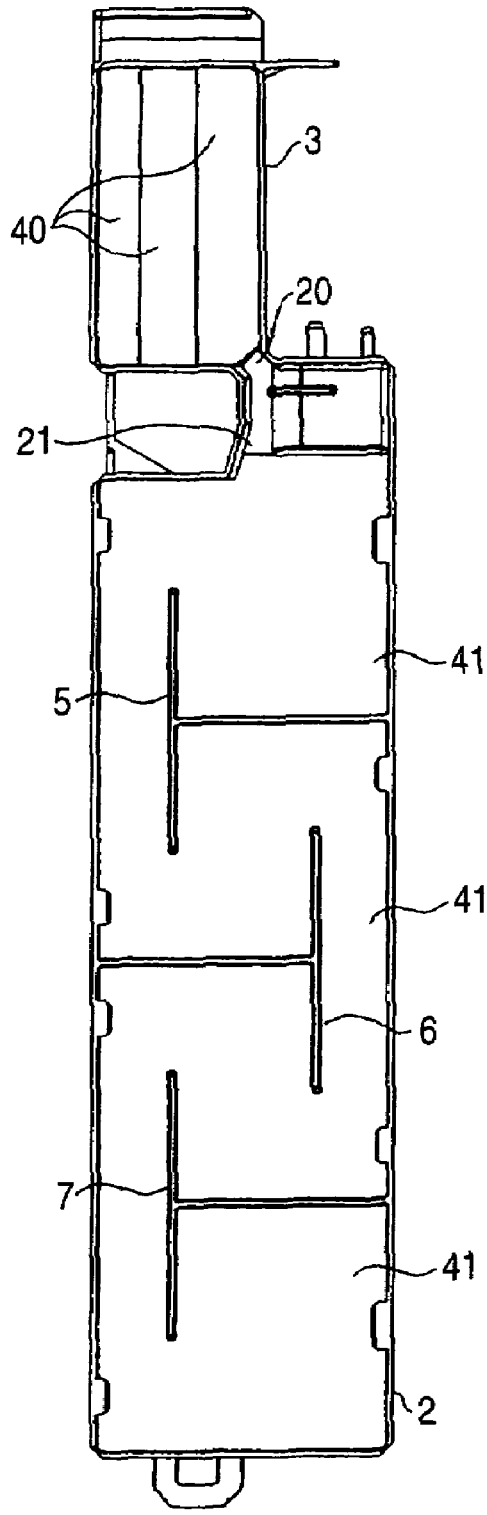
FIG. 4 is a plan view of the waste ink tank according to the first embodiment in a state of use.
Figure 5:
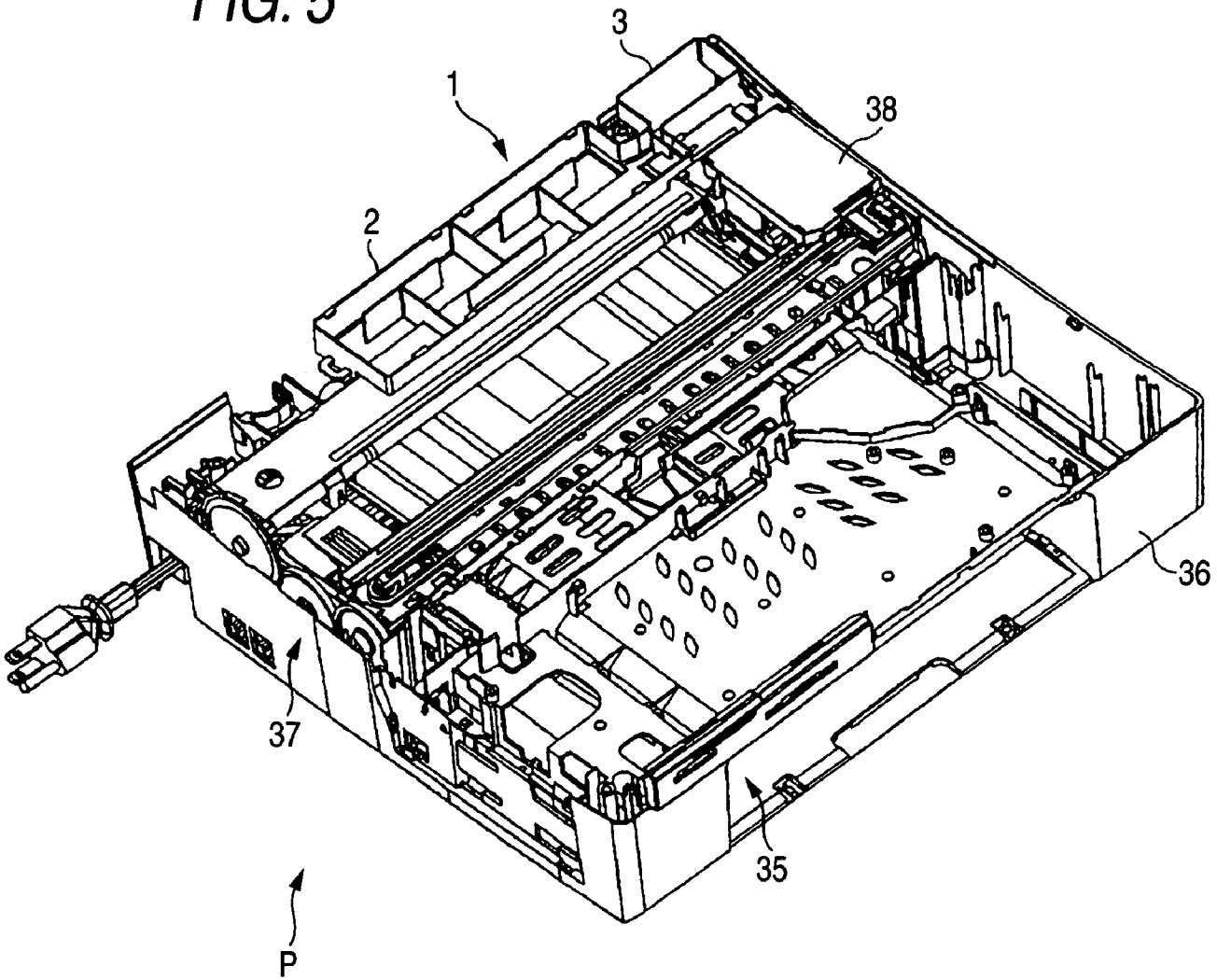
FIG. 5 is a perspective view of the interior of an inkjet printer showing a state of mounting of the waste ink tank according to the embodiment.
Figure 6A:
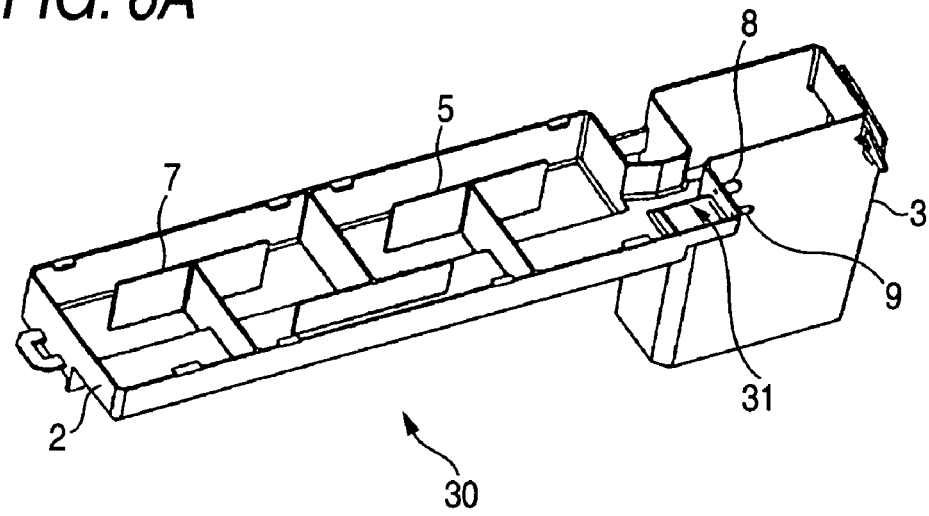
Figure 6B:
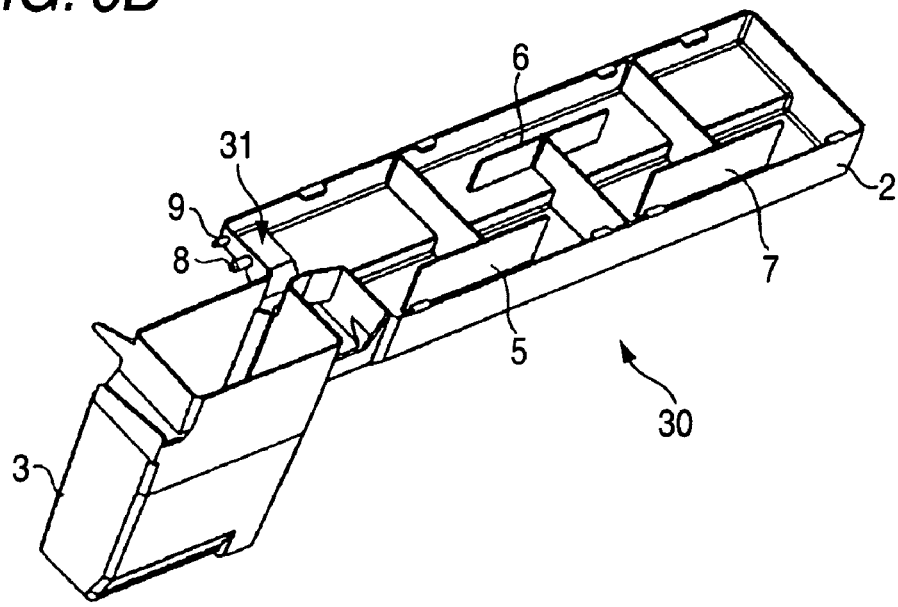
Figure 7:
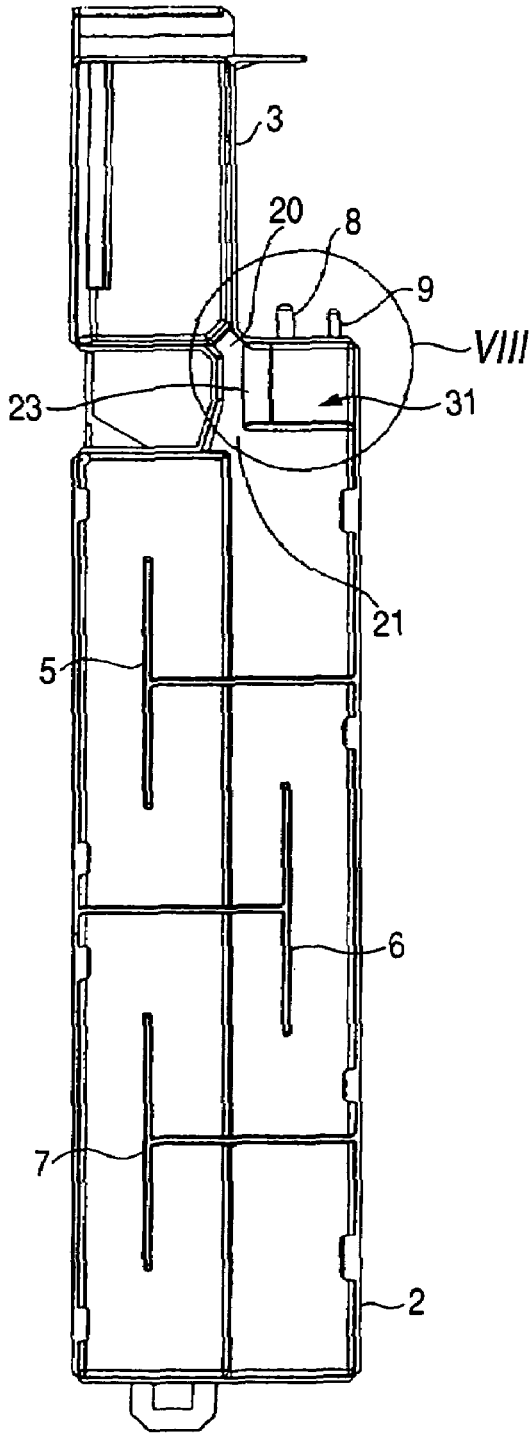
FIG. 7 is a plan view of the waste ink tank according to the second embodiment, showing a detailed configuration thereof.
Figure 8:
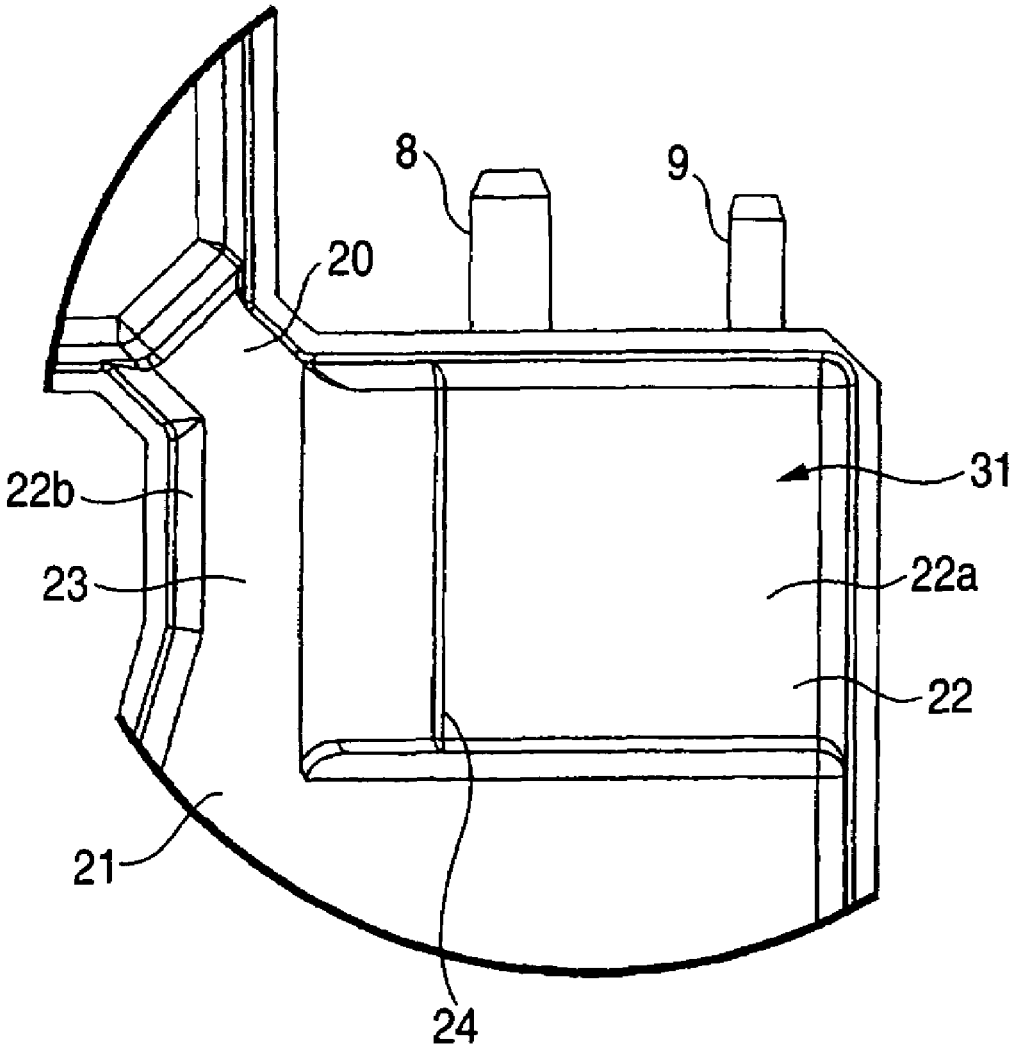
FIG. 8 is an enlarged plan view of the region VIII in FIG. 7.

A first embodiment of the invention will be first described with reference to FIGS. 1A to 5. FIGS. 1A and 1B are perspective views of the exterior of a waste ink tank according to the first embodiment. FIG. 2 is a plan view of the waste ink tank showing a detailed configuration thereof. FIG. 3 is an enlarged plan view of the region III in FIG. 2. FIG. 4 is a plan view of the waste ink tank in use. FIG. 5 is a perspective view of the interior of an inkjet printer showing a state of mounting of the waste ink tank in the same.

A recording head used in this recording apparatus is an inkjet type which ejects ink using a pressure generated by a piezoelectric element. However, the invention is not limited to the same and may be applied to a type in which bubbles are generated utilizing thermal energy to eject ink by the pressure of the bubbles.

A structure of a waste ink tank itself according to the first embodiment will be first described with reference to FIGS. 1A to 3. As shown in FIGS. 1A to 3, a waste ink tank 1 according to the first embodiment is formed using integral molding from a material such as polypropylene. It is constituted by a first storing section 2 having a rectangular parallelepiped general configuration with a small depth and a large opening on a top side thereof provided in an intention to promote evaporation, a second storing section 3 having a rectangular parallelepiped general configuration with a depth greater than that of the first storing section 2 and an opening having a smaller area, and a waste ink receiving section 4 which connects the first storing section 2 and the second storing section 3 so as to allow waste ink to flow into them and to which the waste ink is made to flow from a waste ink pump 100 (see FIG. 2).

The top side of the first storing section 2 and the second storing section 3 are entirely open to use the sections in a state in which they are filled with absorbing foams 40, 41 for absorbing waste ink. The second storing section 3 and the waste ink receiving section 4 are connected such that waste ink can flow from the waste ink receiving section 4 into the second storing section 3 through a communication opening 20.

The top side of the first storing section 2 is also entirely open, and partition walls 5 to 7 having a T-shaped plan configuration are formed integrally with the interior of the section such that they are staggered with each other. Base parts of the partition walls 5 and 7 are formed integrally with one of walls of the first storing section 2, and a base part of the partition wall 6 is formed integrally with another wall of the first storing section 2. The first storing section 2 and the waste ink receiving section 4 are connected by a sloped surface such that waste ink can flow from the waste ink receiving section 4 into the first storing section 2 through a communication opening 21. The first storing section 2 is filled with the absorbing foam to be described later such that the foam continuously extends from the position of the communication opening 21 up to the end of the first storing section 2 opposite to the communication opening 21 via the space between the partition walls 5 to 7 in the first storing section 2. Incidentally, a portion of a bottom wall of the first storing section 2 on a far side from the ink receiving section 4 is made lower such that waste ink is promoted to flow to the far side, and thus more waste ink can be stored.

The waste ink receiving section 4 is connected to tube connecting parts 8 and 9 by tubes (not shown) through which waste ink flows in from the waste ink pump as a suction unit. The tube connecting parts 8 and 9 are formed on a sidewall of the storing secton, and waste ink containing bubbles and thickened ink flows into the waste ink receiving section 4 through openings 8A and 9A of the connecting parts 8 and 9 respectively, which open to the waste ink receiving section 4.

The tube into which the tube connecting part 8 is inserted is connected to an ink cap, which is not shown and which covers the nozzles, and it accepts an in-flow of waste ink sucked by the function of the waste ink pump 100 at a maintenance section (not shown) provided in the printer in which the waste ink tank 1 is mounted.

The tube into which the tube connecting part 9 is inserted is connected to an atmosphere communication opening provided at a switching unit which is not shown, and it guides any waste ink leaking from the atmosphere communication opening to the waste ink tank 1.

Since the amount of waste ink sucked by the waste ink pump is much greater than the amount of waste ink leaking from the atmosphere communication opening, the inner diameter of the tube connecting part 8 (or the diameter of the opening 8A) is formed greater than the inner diameter of the tube connecting part 9 (or the diameter of the opening 9A) as shown in FIGS. 1A to 4.

As shown in FIGS. 1A, 1B and 3, the waste ink receiving section 4 is formed such that a bottom surface 22 thereof is horizontal when the waste ink tank 1 is used. In such a structure, waste ink discharged from the openings 8A and 9A is substantially evenly delivered to the first storing section 2 or second storing section 3 and absorbed by the absorbing foam in the first storing section 2 or the absorbing foam in the second storing section 3 through the respective communication opening 21 or 20. The bottom surface 22 includes a receiving portion 22*a* capable of receiving the waste ink made to flow into the waste ink receiving section 4. The bottom surface 22 further includes a connecting portion 22*b* that connects the first storing section 2 and the second storing section 3.

Further, in a position in front of the opening 8A, a waste ink receiving wall 10 is formed in parallel with the sidewall on which the opening 8A is formed in order to prevent waste ink from scattering when it is discharged from the opening 8A in a large amount at a time, and in order to make waste ink flow evenly and smoothly to the respective ink storing sections.

Furthermore, an inclined surface 23 is provided in a region of the bottom surface 22 of the waste ink receiving section 4 that leads to the connecting portion 22*b* and to the communication openings 20 and 21, the inclined surface extending from a boundary 24 toward the communication openings 20 and 21 which are at an elevation lower than the horizontal bottom surface 22. Thus, waste ink which has flowed into the waste ink receiving section 4 can be smoothly and quickly guided to the communication openings 20 and 21.

Next, a description will now be made with reference to the plan view shown in FIG. 4 on the waste tank 1 having the structure described with reference to FIGS. 1A to 3 in a state in which it is filled with the absorbing foam.

As shown in FIG. 4, the first storing section 2 is used by entirely filling it with absorbing foam 41 except the partition walls 5 to 7. Waste ink is gradually absorbed by the absorbing foam 41 at a surface thereof facing the communication opening 21, and the ink finally soaks the absorbing foam 41 as a whole in the first storing section 2 to be stored and evaporated.

The second storing section 3 is filled with absorbing foam 40 which is divided into three pieces such that the foam entirely fills the interior of the second storing section 3. Waste ink absorbed in one form does not transfer to other forms. Since each piece of the absorbing foam 40 is in the form of a rectangular parallelepiped that is longer in the vertical direction when the waste ink tank 1 is used, absorption of waste ink from the communication opening 20 (absorption in the vertical longitudinal direction of the second storing section 3) quickly proceeds.

Referring specifically to the material of the pieces of absorbing foam 40 and 41, it is appropriate to form the pieces of absorbing foam 40 and 41 using a fiber material such as felt or a porous material.

A state of the waste ink tank 1 according to the present embodiment in use will now be described with reference to FIG. 5. FIG. 5 is a perspective view showing mechanisms inside the printer including the waste ink tank (the pieces of absorbing foam 40 and 41 are omitted in the figure).

As shown in FIG. 5, the printer P of the present embodiment has a housing 36 having an opening provided in a lower part of a front face thereof to serve as a cartridge insertion hole 35 into which a cartridge loaded with recording paper is inserted, and a paper feeding mechanism 37 and a recording head 38 are incorporated in the housing 36. The waste ink tank 1 according to the present embodiment is placed on a guide plate in a space which is located above a curved part of an arcuate guide in a rear upper part of the apparatus body and which is a space between an image reading section and the guide plate. The first storing section 2 and the second storing section 3 are incorporated such that their respective openings face upward.

The waste ink tank 1 according to the present embodiment is incorporated in a rear upper part of the housing 36 such that the openings of the first storing section 2 and the second storing section 3 face upward. Further, the waste ink tank 1 is secured in the housing 36 with a lower part of the second storing section 3 fitted in a rear right corner of the housing 36.

As described above, in the structure of the waste ink tank 1 according to the present embodiment, the waste ink tank 1 is formed by the first storing section 2 which has a smaller depth and a greater opening to evaporate waste ink absorbed in absorbing foam and the second storing section 3 having a greater depth which allows a large amount of waste ink to be accumulated in absorbing foam. Therefore, the tank can achieve both of quick evaporation of waste ink and effective storage of a large amount of waste ink while occupying only a small space.

Since the first storing section 2 and the second storing section 3 are connected by an inner bottom surface 22 of the waste ink receiving section 4 which is horizontal when the tank is used and an inclined surface 23, waste ink can be made to flow into the storing sections substantially evenly.

Further, a waste ink receiving wall 10 is provided so as to face the opening 8A of the waste ink receiving section 4. As a result, since incoming waste ink is delivered to each storing section after hitting the waste ink receiving wall 10, the waste ink can be made to flow into the storing sections smoothly and evenly.

Furthermore, since the waste ink receiving wall 10 is provided in a position facing the opening 8A having a diameter greater than that of the opening 9A, waste ink can be made to flow into the storing sections smoothly even when it is discharged in a large amount.

What is essential is that the waste ink receiving wall 10 is provided at least in the position facing the opening 8A. For example, a waste ink receiving wall having a length ranging from the opening 8A to the opening 9A may alternatively be formed in a position facing the openings 8A and 9A. Alternatively, separate and independent waste ink receiving walls may be formed in positions facing the opening 8A and the opening 9A, respectively.

Since a plurality of partition walls 5 to 7 each having a T-shaped plan configuration are staggered in the first storing section 2, even when the waste ink tank 1 is tilted as a result of transportation of the apparatus, the head pressure of waste ink stored in the first storing section 2 is distributed to each of compartments defined by the partition walls 5 to 7 and is consequently reduced. The waste ink will therefore be unlikely to spill out.

Further, the inclined surface 23 is formed on the bottom of the waste ink receiving section 4 such that it extends at an inclination from the waste ink inlet position toward a communication opening 20 and the communication opening 21, waste ink can be made to flow into the storing sections smoothly.

Furthermore, since continuous absorbing foam 41 is inserted in the space between the partition walls 5 to 7 in the first storing section 2, the head pressure of waste ink between the partition walls 5 to 7 is reduced. Therefore, the waste ink stored in the first storing section 2 is unlikely to spill out even when the waste ink tank 1 is tilted. While the partition walls 5 to 7 have been described as having a T-shaped plan configuration, any shape may be employed as long as the head pressure can be distributed by dividing the tank.

Absorbing foam 40 which is divided in the vertical direction when used is inserted in the second storing section 3. Thus, the migration of waste ink between the parts of absorbing foam 40 is suppressed to make the waste ink unlikely to spill out.

(2) Second Embodiment

Another embodiment or second embodiment of the invention will now be described with reference to FIGS. 6A to 8. In FIGS. 6A to 8, constituent members similar to the members shown in FIGS. 1A to 3 will be indicated by like reference numerals and will not be described in detail.

While the waste ink receiving wall 10 is provided in front of the opening 8A in the above-described first embodiment, a waste ink tank may be formed without such a waste ink receiving wall 10.

Specifically, as shown in FIGS. 6A to 8, an ink tank 30 according to the second embodiment has a structure similar to that of the waste ink tank 1 according to the first embodiment except that it has a waste ink receiving section 31 without a waste ink receiving wall 10.

The waste ink receiving section 31 having such a structure can also guide waste ink to the communication openings 20 and 21 smoothly by providing it with the bottom surface 22 and the inclined surface 23.

The waste ink tank 30 according to the second embodiment as described above can provide advantages similar to those of the waste ink tank 1 according to the first embodiment except in the region associated with the waste ink receiving wall 10.

Figure 9A:
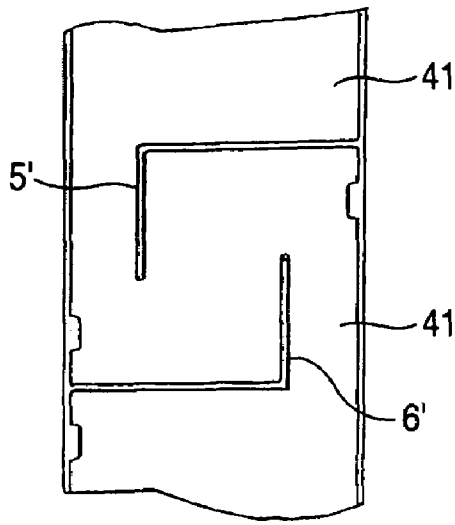
FIGS. 9A and 9B show modifications of partition walls.
Figure 9B:
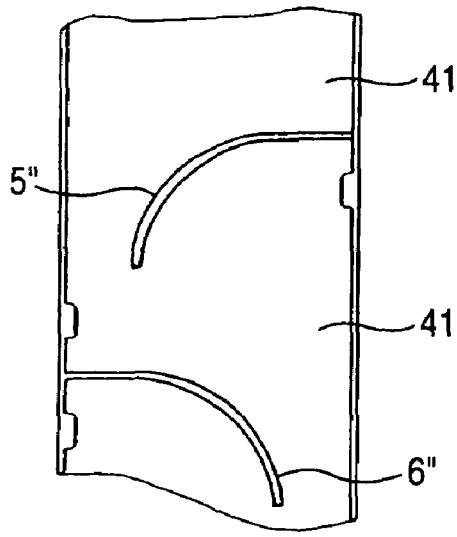

While the above embodiments have been described with reference to a case in which the partition walls 5 to 7 have a T-shaped plan configuration, the partition walls 5 to 7 may alternatively be L-shaped (see FIG. 9A) or in the form of a curved hook (see FIG. 9B) in plan configuration because what is required is that the partition walls have a shape which allows the tank to be divided to distribute the head pressure thereof. Further, the function of partition walls can be provided by forming staggered plates which extend inward from a longitudinal sidewall of the first storing section 2 and which are tilted in the longitudinal direction at a predetermined angle.

As described above, in the waste ink tank 1, a waste ink receiving wall 10 is provided at the waste ink receiving section in a position facing a discharge hole through which the waste ink is discharged.

Since the waste ink receiving section is provided with the waste ink receiving wall 10 facing the discharge hole for discharging waste ink, the discharged waste ink flows into the storing sections after hitting the waste ink receiving wall, which allows the waste ink to flow into the storing sections smoothly and evenly.

Also, the waste ink tank 1 includes a first discharge hole through which the waste ink is discharged and a second discharge hole having a diameter greater than that of the first discharge hole, wherein the waste ink receiving wall 10 is provided at least in a position facing the second discharge hole.

Since the waste ink receiving wall 10 is provided at least in a position facing the second discharge hole having a diameter greater than that of the first discharge hole, waste ink can be made to flow into the storing sections smoothly even if the ink is ejected in a large amount.

Further, the waste ink tank includes a plurality of partition walls 5, 6 formed inside the first storing section, the partition walls extending inward from a longitudinal side wall of the first storing section, wherein the partition walls are staggered such that the waste ink is delivered throughout the first storing section.

Since the plurality of partition walls 5, 6 are staggered inside the first storing section so as to extend inward from the longitudinal side wall of the first storing section, even when the waste ink tank is tilted, a resultant head difference will be divided by the partition walls, and the head pressure in the first storing section as a whole will be reduced. The waste ink stored in the first storing section will therefore be unlikely to spill out.

In addition, each of the partition walls 5, 6 has a T-shaped plan configuration.

Since each of the partition walls 5, 6 has a T-shaped plan configuration, even when the waste ink tank is tilted, a resultant head difference can be effectively divided.

Additionally, each of the partition walls 5, 6 may be L-shaped in plan configuration.

Since each of the partition walls 5, 6 is L-shaped in plan configuration, even when the waste ink tank is tilted, a resultant head difference can be effectively divided.

Alternatively, each of the partition walls 5, 6 may have a plan configuration in the form of a curved hook.

Since each of the partition walls 5, 6 has a plan configuration in the form of a curved hook, even when the waste ink tank is tilted, a resultant head difference can be effectively divided.

Further, the waste ink receiving section 4 is formed with a first communication surface through which the waste ink receiving section and the first storing section are communicated with each other and a second communication surface through which the waste ink receiving section and the second storing section are communicated with each other and wherein an inclined surface is formed on the bottom so as to extend at an inclination from the waste ink inlet position of the ink receiving unit toward the first communication surface and the second communication surface.

Since the inclined surface 23 is formed on the bottom of the waste ink receiving section so as to extend at an inclination from the waste ink inlet position toward the first communication surface and the second communication surface, waste ink can be made to flow into each storing section smoothly.

Also, the waste ink absorbing body 41 for absorbing and holding the waste ink is inserted in a space between the partition walls in the first storing section.

Since the waste ink absorbing body 41 is inserted in the space between the partition walls in the first storing section, a head pressure between the partition walls is reduced. The waste ink stored in the first storing section will therefore be unlikely to spill out even when the waste ink tank is tilted.

Furthermore, a waste ink absorbing body 40 is inserted in the second storing section, the ink absorbing body being divided into pieces along the vertical direction and absorbing and holding the waste ink when the tank is used.

Since the waste ink absorbing body 40 which is divided into pieces in the vertical direction is inserted in the second storing section, waste ink can be quickly absorbed by the waste ink absorbing material even when the ink is ejected in a large amount at a time.

Further, since the waste ink absorbing body 41 in the first storing section and the waste ink absorbing body 40 in the second storing section are separated by the waste ink receiving section, a head difference is further divided to reduce the head pressure. Waste ink will therefore be more unlikely to spill out.

Further, when either of the first storing section 2 and the second storing section 3 is filled with waste ink, waste ink no longer flows into the storing section which has become full. Consequently, waste ink can be evenly stored in the first storing section and the second storing section.

Embodiments will be disclosed below, in which top sides of a first storing section 2 and a second storing section 3 constituting a waste ink tank 1 are covered with a film to prevent waste ink absorbed in pieces of absorbing foam 40 and 41 from leaking to smear the interior of the apparatus body when the apparatus is tilted. In a third embodiment, a film is used to cover a region inside a first storing section 2 in which absorbing foam 40 is not contained and which is in the neighborhood of a waste ink receiving section 4. In a modification of the third embodiment, a box-like first storing section which has a small depth and which is open on a top side thereof is covered with films in positions in the longitudinal direction thereof where the section faces a second storing section 3. In a fourth embodiment, the region of top sides of a first storing section 2 and a second storing section 3 is entirely covered with films which are formed with holes for evaporation as occasion demands.

(3) Third Embodiment

Figure 10:
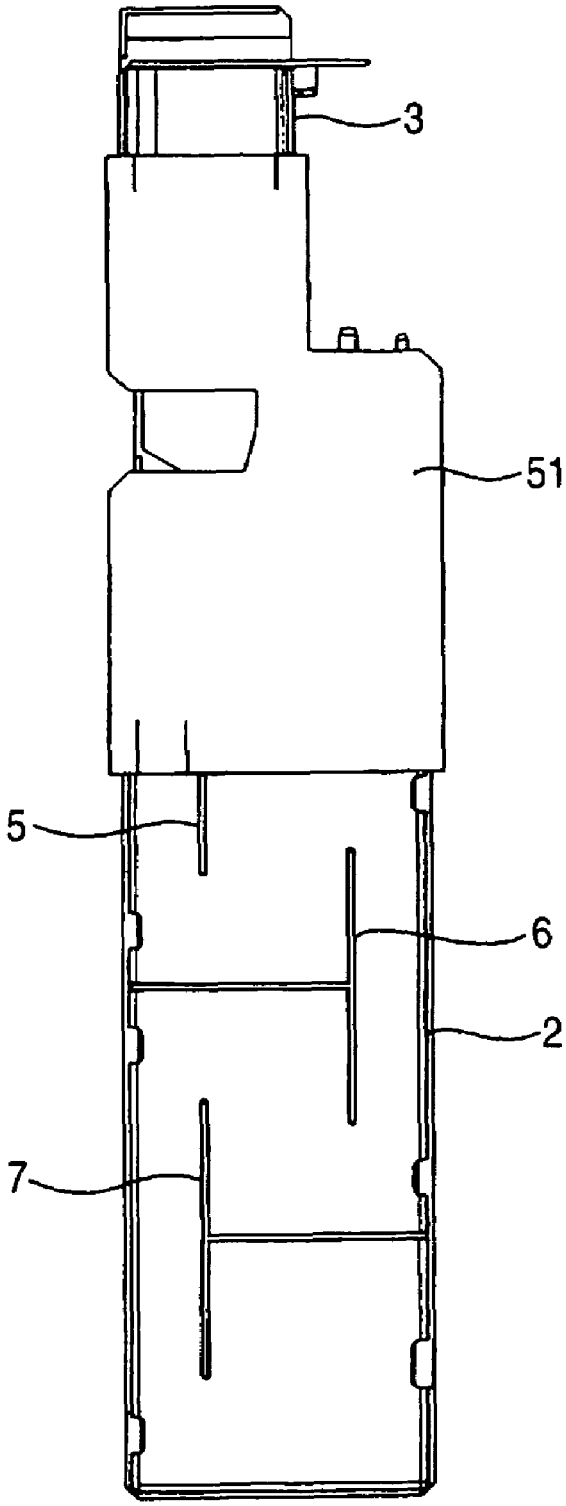
FIG. 10 is a perspective view of the exterior of a waste ink tank according to a third embodiment.

The third embodiment of the invention will now be described with reference to FIG. 10. In FIG. 10, constituent members similar to the members shown in FIGS. 1A to 3 will be indicated by like reference numerals and will not be described in detail.

Just as in the first and second embodiments described above, a first storing section 2 and a second storing section 3 constituting a waste ink tank 1 are filled with pieces of absorbing foam 40 and 41, respectively. Normally, a waste ink receiving section 4 which is a section providing communication between the first storing section 2 and the second storing section 3 is not filled with the absorbing foam 40 because the foam becomes a load when ink flows in. Therefore, when the apparatus is transported with the waste ink tank tilted, ink accumulated in the pieces of absorbing foam 40 and 41 and the waste ink receiving section 4 can leak out the tank into the interior of the apparatus body through an inner wall of the tank and partition walls 5 to 7 which are erected perpendicularly to the bottom of the tank.

When a maintenance mechanism for removing bubbles accumulated in ink channels and an ink tank is provided, the bubbles collect at the waste ink receiving section 4, and the bubbles are broken and splashed as a result of collision with waste ink containing bubbles that flows in from openings 8A and 9A, the splashes being deposited on a paper transporting surface such as a transport path. Specifically, the waste ink tank 1 is disposed above a transport path and in a position in which it is substantially in parallel with a carriage (see FIG. 5). Therefore, ink is likely to drop on the transport path to smear the bottom surface of the next sheet of paper (the surface opposite to the side on which an image is formed) transported. When ink is splashed during formation of an image on paper, the waste ink is deposited in the form of points on the paper, which results in degradation of the quality of the recorded image.

For this reason, a film 51 is secured through welding such that it covers the top side of the waste ink receiving section 4 in which the absorbing foam 40 is not contained. The film 51 may cover only the ink receiving section 4 in order to maintain the effect of ink evaporation that is a function provided to the first storing section 2 by making it shallow and providing it with an opening having a large area. Thus, it is possible to prevent scattering of waste ink that occurs when waste ink is sucked during a maintenance process and to prevent ink accumulated in the ink receiving section 4 from leaking out the section into the interior of the apparatus body through an inner wall of thereof even when the apparatus body is tilted during transportation.

Further, in order to prevent ink from spilling out as a result of a change in attitude or vibration during transportation, the film 51 preferably covers the part of the absorbing foam 41 on the side of the ink receiving section 4 up to the partial wall of the partition wall 5 that is orthogonal to the longitudinal direction of the first storing section 2. Since there is an ink inlet opening at the part of the absorbing foam on the side of the ink receiving section 4, ink is frequently accumulated on the bottom of the tank in an amount in the excess of the holding capacity of the absorbing foam 41. Since the part is covered by the film 51, it is possible to prevent the accumulated ink from flowing from the bottom to leak out the tank into the interior of the apparatus body through an inner wall of the tank when the apparatus is tilted.

(3-1) First Modification

Figure 11:
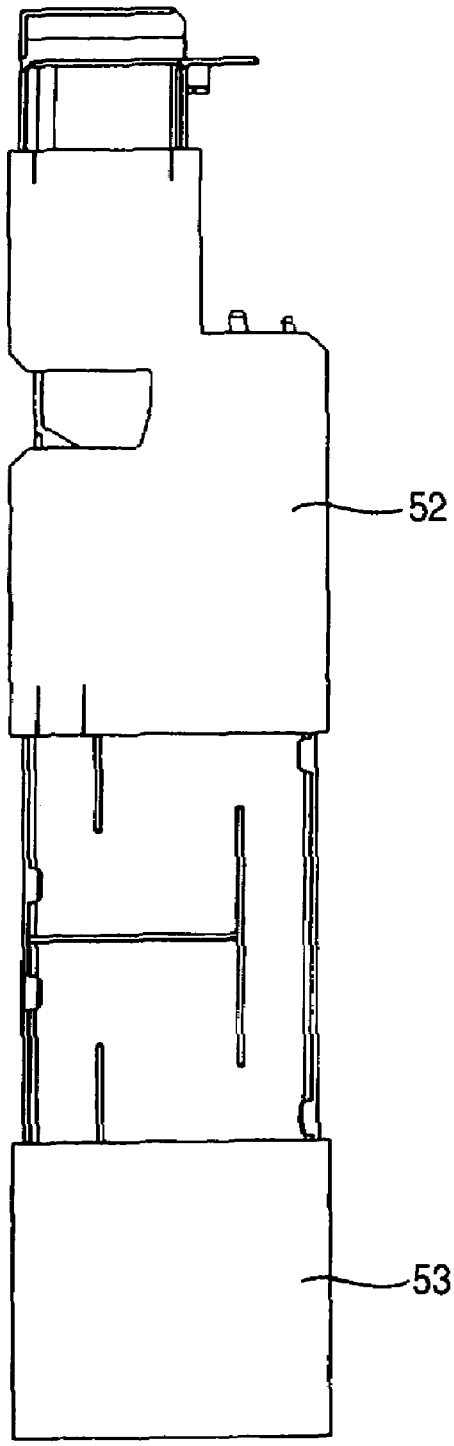
FIG. 11 is a plan view of a first modification of the waste ink tank according to the third embodiment.

A modification of the third embodiment will now be described with reference to FIG. 11. The first storing section 2 is formed like a box having a small depth and an opening on a top side thereof, and absorbing foam 41 is contained on the opening. The first storing section 2 is intended for evaporation, and it therefore has a large opening area and a small depth to promote evaporation. The first storing section 2 contains a smaller amount of waste ink than the second storing section 3. The second storing section 3 is formed like a box which is deeper and which is open on a top side thereof. A greater amount of ink can be stored in the second storing section 3. A plurality of pieces of absorbing foam 41 is contained in the opening in parallel with the direction in which ink flows in. Since a plurality of pieces of absorbing foam 41 is contained, a flow of ink is temporarily interrupted at each of the gaps between the pieces of absorbing foam 41. Therefore, when the apparatus body is installed at an inclination, the migration of ink between the pieces of absorbing foam can be hindered to prevent the ink from easily leaking out the second storing section 3. The absorbing foam 41 preferably has a layer to suppress cubing at the periphery thereof.

In the present modification, not only a film 52 is welded to the ink receiving section 4 of the first storing section 2, but also a film 53 is welded to the opposite side or end of the storing section along the top side of the tank. In the case where the first storing section 2 is in an inclined attitude with the end of the same located at the bottom when the apparatus is transported after it is put in use and that ink held in the absorbing foam 41 consequently starts flowing. Then, since the film 53 covers the inner wall of the tank and closes the top side of the same, the ink is prevented from leaking out through the inner wall.

(3-2) Second Modification

Figure 12:
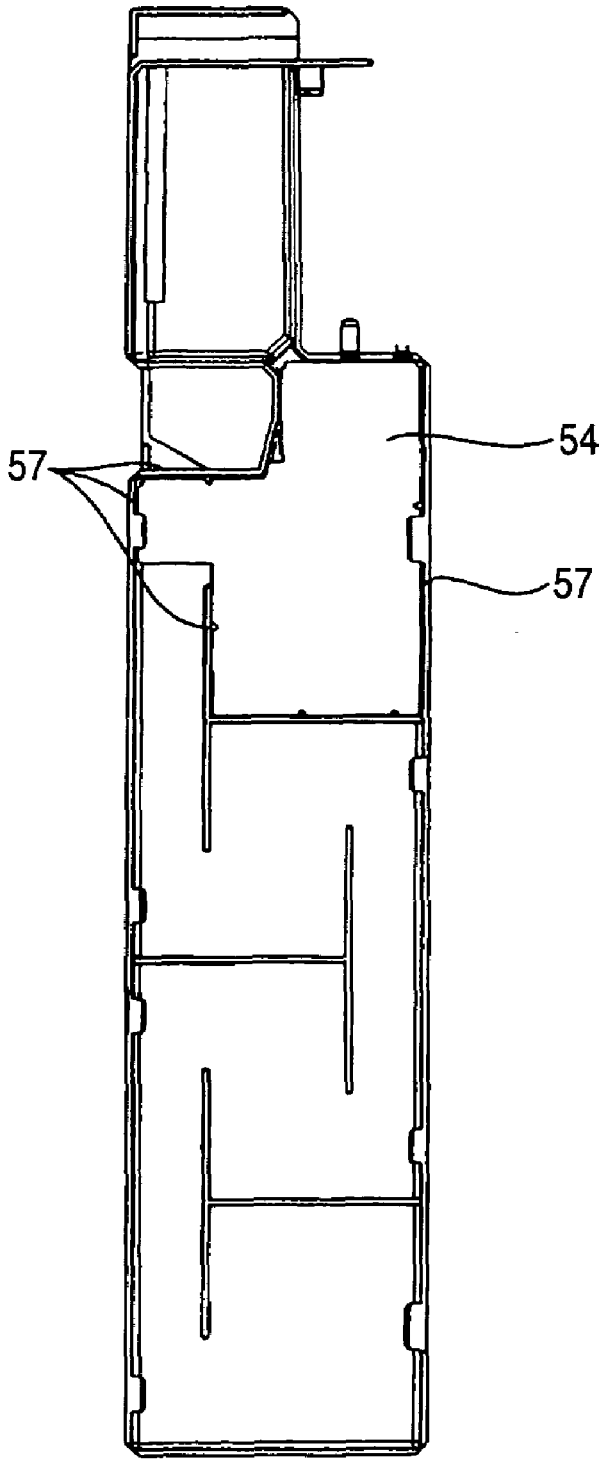
FIG. 12 is a plan view of a second modification of the waste ink tank according to the third embodiment.

A description will now be made with reference to FIG. 12 on an example, as another modification of the third embodiment, in which a top side of a first storing section 2 is not sealed with a film 54 using securing means such as welding. Referring to FIG. 12, the film 54 has a leg part 57 that is suspended from the top side. The leg part 57 is configured such that it can be attached to the first storing section 2, and it is attached to the periphery of the film 54 along an inner wall of the tank as occasion demands.

For example, when applied to a recording apparatus which is always set in a predetermined direction even in transportation by using a dedicated container, e.g., a relatively large inkjet plotter to be installed in an office, the present modification is characterized in that it provides covering means comprising a film 54 for covering an opening of a first storing section 2 for storing waste ink and a leg part 57 suspended from the film. Since the film 54 can be attached and detached as occasion demands, the film 54 that is covering means is preferably attached to the first storing section 2 when waste ink can scatter to smear the interior of the apparatus. Further, since the film 54 is not secured to the tank using a method such as welding, pieces of absorbing foam 40 and 41 can be contained in the tank in contact with an inner wall of the same. When the leg part 57 is mounted by inserting it between the pieces of absorbing foam 40 and 41 and the tank inner wall, ink can be temporarily held by the film even if the tank is tilted.

(4) Fourth Embodiment

Figure 13:
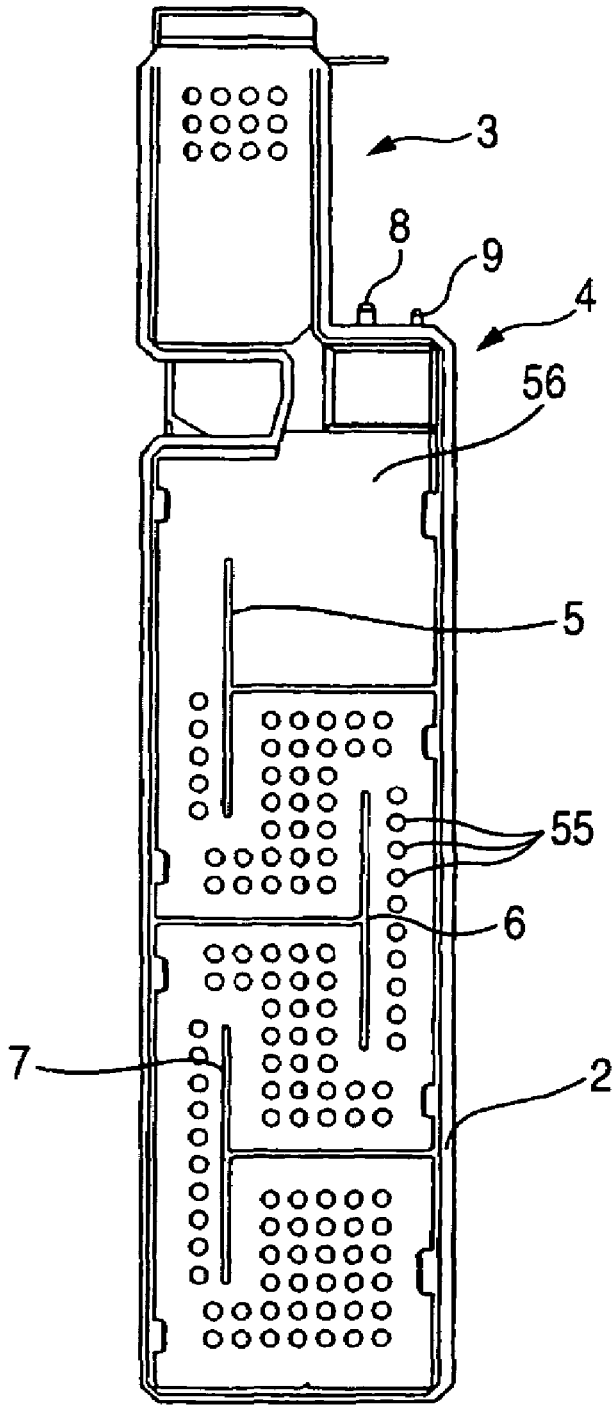
FIG. 13 is a plan view of a waste ink tank according to a fourth embodiment showing a detailed configuration thereof.

Another embodiment or fourth embodiment of the invention will now be described with reference to FIG. 13. In FIG. 13, constituent members similar to the members shown in FIGS. 1A to 3 are indicated by like reference numerals and will not be described. Ink can flow into a waste ink tank 1 according to the embodiment through a tube connecting part 8 into which waste ink sucked by the function of a waste ink pump as described above flows and a tube connecting part 9 that is connected to an atmosphere communication hole.

A film 56 entirely covers a top side of the waste ink tank, and the film is welded to an outer wall of the tank. When the apparatus is transported in an inclined attitude after it is put in use, ink absorbed by pieces of absorbing foam 40 and 41 can leak out into the interior of the apparatus body through an inner wall of the tank 1. The leakage ink can drop on a conveying path to smear the bottom surface of the next sheet of paper (the surface opposite to the side on which an image is formed) conveyed. When the ink is scattered on the paper during formation of an image, the scattered ink is deposited on the paper to degrade the quality of the recorded image. Under the circumstance, the top surface of the outer wall of the waste ink tank 1 is entirely covered with the film 56, and the film is secured using welding to eliminate any gap between the top surface and the film.

In order to allow evaporation of ink absorbed in the pieces of absorbing foam 40 and 41, the film 54 is formed with a multiplicity of holes 55 along partition walls 5 to 7 which are staggered. The multiplicity of holes 55 are provided such that they surround the partition walls 5 to 7 in regions away from the neighborhood of the inner wall of the tank. Thus, the ink absorbed in the absorbing foam 41 can be expected to evaporate, and leakage of the ink attributable to transportation or vibration can be prevented. The holes 55 for evaporation are formed except the neighborhood of the partition walls 5 to 7 which are dividing means for dividing the interior of the storing means into a plurality of areas. Waste ink resides in the absorbing foam 41 that is closer to an ink receiving section 4 in an amount in the excess of the absorbing capacity of the foam, and the waste ink can leak out the tank into the interior of the apparatus through the evaporation holes 55 when the apparatus is tilted in such a state. For this reason, the holes 55 for evaporation are spaced from the partition walls 5 to 7 formed in the first storing section 2 and the inner wall that constitutes an outer frame of the storing section 2. It is preferable that the holes are not formed on the side of the partition wall 5 toward the ink receiving section 4 as viewed in the longitudinal direction of the first storing section 2. The purpose is to prevent ink accumulated in the ink receiving section from leaking through the partition wall 5.

Further, ink is made to flow forcibly into the ink receiving section 4 by a pump, and any thickened ink accumulated in the ink receiving section 4 can hinder the flow of ink and can consequently hinder a maintenance operation. For this reason, the absorbing foam 41 is not disposed in the neighborhood of the ink receiving section 4 normally. Incidentally, ink always resides in the ink receiving section 4, although only in a small amount. Therefore, the ink can leak out the section into the interior of the apparatus to smear the conveying path when the apparatus is transported or tilted after it is put in use. For this reason, the waste ink tank as a whole including the ink receiving section 4 is covered with the films. The holes are formed only on the side of the partial wall of the partition wall 5 extending in the width direction of the tank, on which the partition wall 7 is located. Thus, leakage of ink from the ink receiving section 4 can be suppressed further.

The film 56 has been disclosed as having evaporation holes 55 formed therein, and importance is attached to evaporation of waste ink accumulated in the first storing section 2. For example, it is not necessary to form the evaporation holes 55 at all in the case of a first storing section 2 that can be replaced when a predetermined amount of waste ink is accumulated therein.

(5) Fifth Embodiment

Figure 14A:
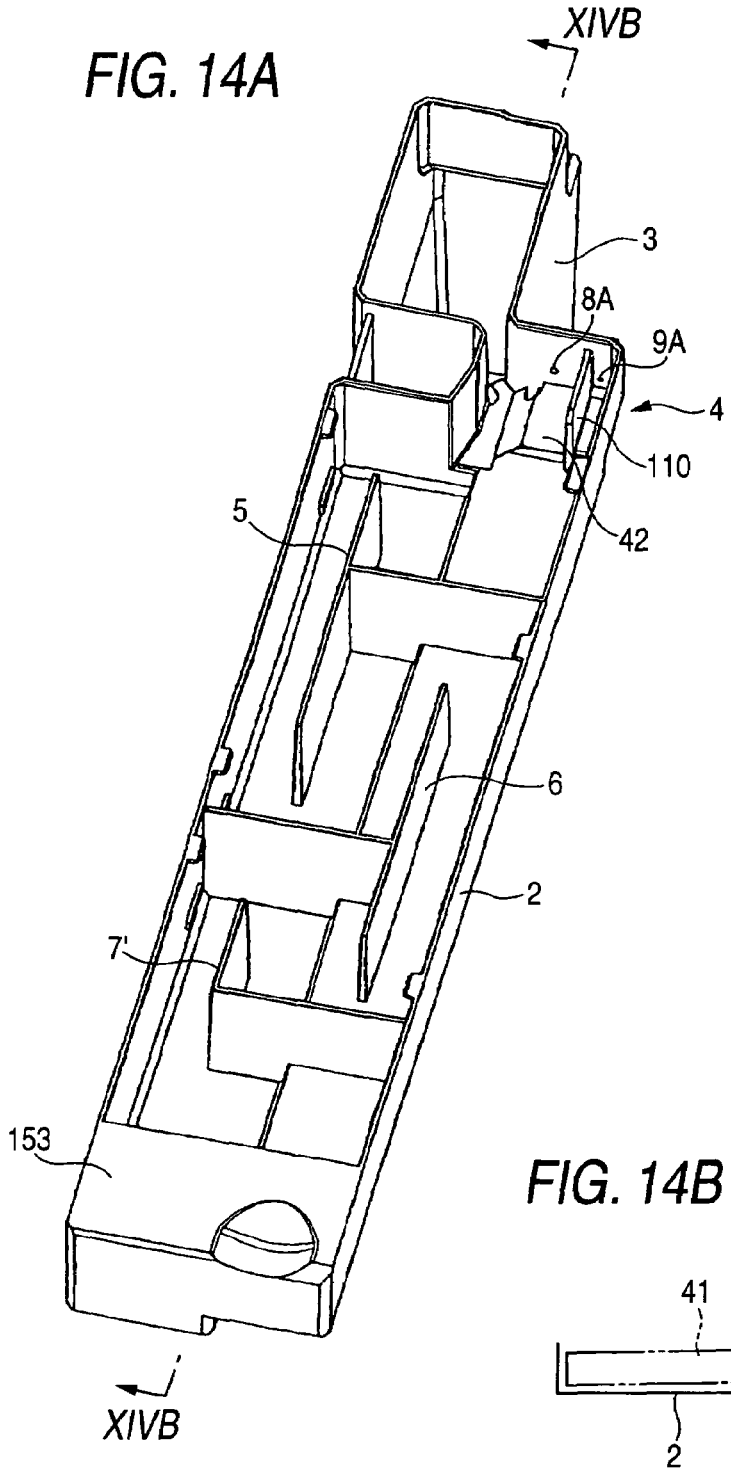
FIG. 14A is a perspective view of a waste ink tank according to a fifth embodiment and FIG. 14B is a schematic sectional view taken along line XIVB-XIVB in FIG. 14A.
Figure 14B:
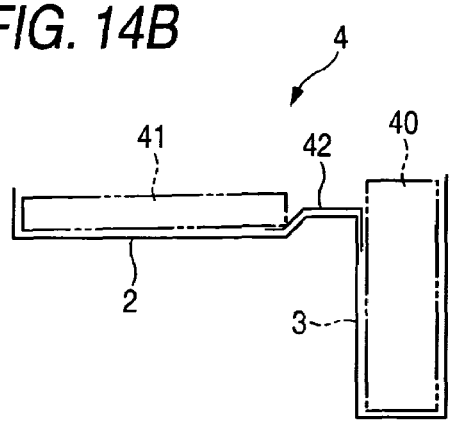
Figure 15:
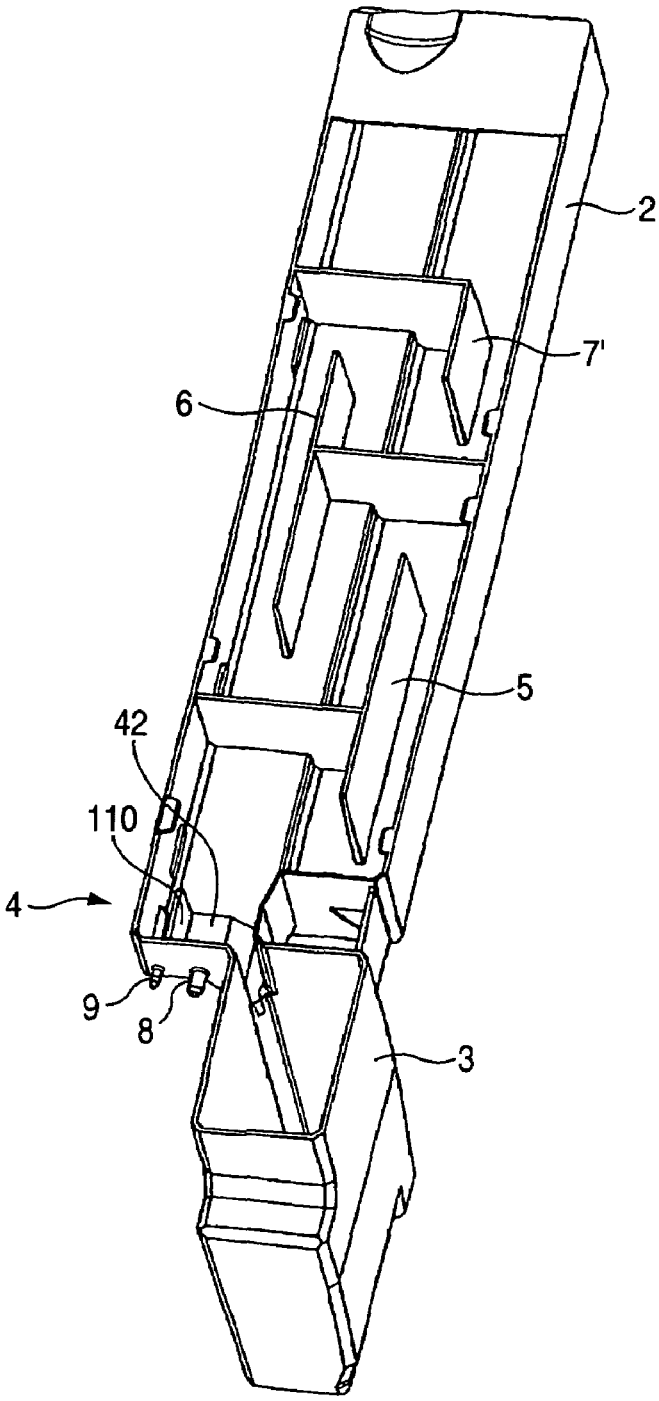
FIG. 15 is another perspective view of the waste ink tank according to the fifth embodiment.

A fifth embodiment will now be described with reference to FIGS. 14A, 14 Band 15. A first storing section 2 has two T-shaped partition walls 5, 6 and an L-shaped partition wall 7'. As shown in FIG. 14B, an absorbing foam 41 is to be contained in the first storing section 2, and an absorbing form 40 is to be contained in a second storing section 3. On a bottom surface of a waste ink receiving section 4, a thin absorbing piece 42 is provided instead of an ink receiving wall that faces to an openings 8A, 9A of connecting parts 8, 9. The absorbing piece 42 extends to the first and second storing sections 2, 3, so that ends of the absorbing piece 42 overlap with the absorbing foams 41, 40. This thin absorbing piece 42 makes the waste ink flow evenly and smoothly to the respective ink storing sections 2, 3. Further, the absorbing piece 42 prevents the waste ink discharged into the waste ink receiving section 4 from splashing.

A film (not shown) covers over the ink receiving section 4. Further, a cover 153 is integrally formed on the opposite side or end of the first storing section 2. The cover 153 is integrally molded with the first storing section 2. The cover 153 effectively prevents leakage of the waste ink. Since the cover 153 is integrally formed with the first storing section 2, an assembly work of attaching a separate cover to the first storing section 2 is eliminated.

On the bottom surface of the waste ink receiving section 4, a wall 110 that extends between the openings 8A and 9A and partitions them is provided. The amount of waste ink discharged from the opening 8A is relatively large. The wall 110 prevents the waste ink discharged from the opening 8A flowing into the opening 9A.

Although the invention is preferably used in inkjet recording apparatus, it is not limited to such printers, and significant advantages can be achieved especially when the invention is applied to a multi function devices having an inkjet type recording section (specifically, multi function devices having functions of at least two among a facsimile machine, a copier, and a scanner in addition to functions of a printer).

What is claimed is:

1. A waste ink tank comprising:

a first storing section capable of storing waste ink, which has an evaporation opening for the waste ink;

a second storing section capable of storing waste ink, which is deeper than the first storing section, the second storing section having an evaporation opening which is smaller than that of the first storing section; and a waste ink receiving section having a bottom surface that has a receiving portion capable of receiving the waste ink made to flow into the waste ink receiving section and a connecting portion connecting the first storing section and the second storing section, and that is horizontal when the waste ink tank is used.

2. The waste ink tank according to claim 1, further comprising:

a discharge hole through which the waste ink is made to flow into the waste ink receiving section when the waste ink tank is used; and a waste ink receiving wall provided at the waste ink receiving section in a position facing the discharge hole.

3. The waste ink tank according to claim 2, wherein the discharge hole comprises:

a first discharge hole; and a second discharge hole having a diameter greater than that of the first discharge hole;

wherein the waste ink receiving wall is provided at least in a position facing the second discharge hole.

4. The waste ink tank according to claim 1, further comprising a plurality of partition walls formed inside the first storing section having a rectangular shape on a plan view, the partition walls extending inward from a longitudinal side wall of the first storing section;

wherein the partition walls are staggered such that the waste ink is delivered throughout the first storing section.

5. The waste ink tank according to claim 4, wherein each of the partition walls has a T-shaped plan configuration.

6. The waste ink tank according to claim 4, wherein each of the partition walls has an L-shaped plan configuration.

7. The waste ink tank according to claim 4, wherein each of the partition walls has a plan configuration in the form of a curved hook.

8. The waste ink tank according to claim 4, wherein a waste ink absorbing body for absorbing and holding the waste ink is inserted in a space between the partition walls in the first storing section.

9. The waste ink tank according to claim 1, wherein the waste ink receiving section comprises:

a first communication path through which the waste ink receiving section and the first storing section are communicated with each other;

a second communication path through which the waste ink receiving section and the second storing section are communicated with each other; and an inclined surface formed on the bottom surface and extending from the receiving portion toward the connecting portion.

10. The waste ink tank according to claim 1, wherein a waste ink absorbing body for absorbing and holding the waste ink is inserted in the second storing section, the ink absorbing body being divided into pieces along a vertical direction.

11. The waste ink tank according to claim 1, further comprising:

a waste ink absorbing body contained in the first storing section; and a cover that covers at least an area, in which the waste ink absorbing body is not contained, in a vicinity of the waste ink receiving section of the first storing section.

12. The waste ink tank according to claim 11, wherein the cover does not cover a side of the first storing section which is opposite to a side of the waste ink receiving section.

13. The inkjet recording apparatus according to claim 11, wherein the cover comprises a top surface part that covers at least the waste ink receiving section and a leg part which is suspended from the top surface part and detachably attached to the waste ink receiving section.

14. The inkjet recording apparatus according to claim 1, further comprising:

a discharge hole through which the waste ink is made to flow into the waste ink receiving section when the waste ink tank is used;

waste ink absorbing bodies contained in the first and second storing sections, respectively; and an absorbing piece disposed on the waste ink receiving section, the absorbing piece is in contact with the waste ink absorbing bodies contained in the first and second storing sections.

15. The inkjet recording apparatus according to claim 1, further comprising:

first and second discharge holes through which the waste ink is made to flow into the waste ink receiving section when the waste ink tank is used, the second discharge hole having a diameter greater than that of the first discharge hole; and a wall that extends between the first and second discharge holes and partitions the first and second discharge holes.

16. A waste ink tank comprising:

a storing section that is open on a top side thereof;

a waste ink receiving section to which waste ink is made to flow, the waste ink receiving section being formed in the storing section;

a waste ink absorbing body that is contained in a portion of the storing section other than a portion where the waste ink receiving section is formed and holds the waste ink; and a cover that covers at least the waste ink receiving section.

17. The waste ink tank according to claim 16, wherein the cover covers at least a portion of the waste ink absorbing body, the portion being adjacent to the waste ink receiving section.

18. The waste ink tank according to claim 16, wherein the cover entirely covers a top surface of the storing section; and the cover is formed with a hole for evaporation of the waste ink.

19. The waste ink tank according to claim 18, wherein the hole for evaporation is formed apart from an inner wall erected from a bottom surface of the storing section and a dividing section that divides the storing section into a plurality of areas.

20. The inkjet recording apparatus according to claim 16, wherein the cover comprises a portion that is integrally formed with the storing section.

21. The waste ink tank according to claim 16, wherein the cover covers an entire part of the waste ink receiving section.

22. The waste ink tank according to claim 16, wherein the cover further comprises a film.

23. An inkjet recording apparatus comprising:

a paper supplying unit on which a paper is placed;

a transporting unit which transports the paper from the paper supplying unit while U-turning the paper from a lower side to an upper side in a transporting path, the transporting path including a curve of a U-turn;

a recording unit that forms an image on the paper in the transporting path;

a sucking unit that sucks waste ink from the recording unit; and a storing section provided outside of the transporting path, the storing section storing the waste ink sucked by the sucking unit, wherein the storing section comprises a first storing section which is shallow and a second storing section which is deeper than the first storing section, and a top side of the first storing section is substantially flush with a top side of the second storing section.

24. The inkjet recording apparatus according to claim 23, wherein the storing section comprises a first storing section which is shallow and open on a top side thereof and which contains an absorbing body in the opening and a second storing section which is deeper than the first storing section and which has an opening smaller than that of the first storing section; and the first storing section is provided above a guide located outside the curve of the transporting path and the second storing section is located at an area that does not vertically overlap with the transporting path.

25. The waste ink tank according to claim 23, wherein at least a part of the storage section is positioned above the curve of the U-turn of the transporting path.

26. The waste ink tank according to claim 23, wherein an opening is formed on each of the top sides of the first storing section and the second storing section.

27. The waste ink tank according to claim 23, wherein the transporting unit keeps a surface of the paper substantially parallel with a predetermined plane at the lower side and the upper side in the transporting path, and wherein at least a part of the first storing section is positioned to overlap the transporting path when viewed from a direction orthogonal to the predetermined plane.

28. The waste ink tank according to claim 27, wherein at least a part of the first storing section overlaps the curve of the U-turn of the transporting path.

29. The waste ink tank according to claim 23, wherein the transporting unit keeps a surface of the paper substantially parallel with a predetermined plane at the lower side and the upper side in the transporting path, and wherein the second storing section is positioned not to overlap the transporting path when viewed from a direction orthogonal to the upper side of the transporting path.

* * * * *